US008616933B2

(12) United States Patent
Yu et al.

(10) Patent No.: US 8,616,933 B2
(45) **Date of Patent: *Dec. 31, 2013**

(54) DYNAMO POWERED TOY

(75) Inventors: Sun Yu, Berkley, MI (US); David Perrin, Warren, MI (US)

(73) Assignee: Sun Yu, Berkley, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/563,722

(22) Filed: Jul. 31, 2012

(65) Prior Publication Data

US 2012/0302126 A1 Nov. 29, 2012

Related U.S. Application Data

(63) Continuation of application No. 11/692,233, filed on Mar. 28, 2007, now Pat. No. 8,257,136, which is a continuation-in-part of application No. 11/253,522, filed on Oct. 19, 2005, now Pat. No. 7,679,320, said application No. 13/563,722 is a continuation-in-part of application No. 11/405,899, filed on Apr. 18, 2006, now Pat. No. 7,259,541, which is a continuation-in-part of application No. 10/600,260, filed on Jun. 20, 2003, now Pat. No. 6,995,542, which is a continuation-in-part of application No. 10/101,907, filed on Mar. 19, 2002, now Pat. No. 7,030,592, said application No. 13/563,722 is a continuation-in-part of application No. 11/462,414, filed on Aug. 4, 2006, now Pat. No. 8,298,036.

(51) Int. Cl.
*A63H 13/16* (2006.01)

(52) U.S. Cl.
USPC ..... 446/310; 446/303

(58) Field of Classification Search
USPC ..... 463/310; 446/36, 444, 456
See application file for complete search history.

(56) References Cited

U.S. PATENT DOCUMENTS

| | | | |
|---|---|---|---|
| 4,130,963 | A | 12/1978 | Ohashi |
| 4,335,318 | A | 6/1982 | Mabuchi et al. |
| 4,354,448 | A | 10/1982 | Lin |
| 4,360,860 | A | 11/1982 | Johnson et al. |
| 4,443,967 | A | 4/1984 | Jones et al. |
| 4,559,022 | A | 12/1985 | Herstein et al. |

(Continued)

FOREIGN PATENT DOCUMENTS

| | | | |
|---|---|---|---|
| DE | 3502394 | A1 | 1/1985 |
| DE | 199 34 861 | C1 | 7/1999 |

(Continued)

*Primary Examiner* — Tramar Harper
(74) *Attorney, Agent, or Firm* — Blue Filament Law PLLC; Avery N. Goldstein

(57) ABSTRACT

A toy is provided that has a dynamo for converting manual movement into an electrical charge for the dynamo located within a housing. A miniature vehicle is induced to locomote through receipt of the electrical charge. A dock is provided for selectively creating an electrical coupling of the vehicle to the dynamo to transfer the electrical charge and decoupling to allow the vehicle to locomote. A charge storage device and an electrical motor in the vehicle allow for prolonged vehicle locomotion separate from the charge transfer by the dynamo. A toy is also provided that has a dynamo for converting manual movement into an electrical charge, the dynamo located within a housing. The dynamo transfers an electrical charge to a wheeled miniature vehicle through an electrically conductive circuit about which the vehicle travels. Additional amusement functions of LED light output or speaker auditory output are optionally provided.

17 Claims, 7 Drawing Sheets

(56) References Cited

U.S. PATENT DOCUMENTS

| | | | | |
|---|---|---|---|---|
| 5,297,982 | A | 3/1994 | Filoseta | |
| 5,880,532 | A | 3/1999 | Stopher | |
| 6,291,900 | B1 * | 9/2001 | Tiemann et al. | 290/1 A |
| 6,568,980 | B2 * | 5/2003 | Barthold | 446/36 |
| 6,585,618 | B2 | 7/2003 | Lu | |
| 6,588,918 | B1 | 7/2003 | Millar | |
| 6,821,184 | B1 * | 11/2004 | Yeung | 446/456 |
| 6,914,340 | B2 | 7/2005 | Becker et al. | |
| 6,943,459 | B2 | 9/2005 | Hartman et al. | |
| 6,995,542 | B2 | 2/2006 | Yu et al. | |
| 7,030,592 | B2 | 4/2006 | Yu | |
| 2002/0098770 | A1 | 7/2002 | Mesch | |
| 2004/0130156 | A1 | 7/2004 | Hartman et al. | |
| 2004/0185747 | A1 * | 9/2004 | Chiu | 446/444 |
| 2005/0153661 | A1 | 7/2005 | Beck | |
| 2006/0154690 | A1 | 7/2006 | Hess | |
| 2007/0025102 | A1 | 2/2007 | Yu | |
| 2007/0080814 | A1 | 4/2007 | Ellsworth et al. | |
| 2007/0173172 | A1 | 7/2007 | Yu et al. | |
| 2008/0026669 | A1 | 1/2008 | Rehkemper et al. | |
| 2010/0041311 | A1 * | 2/2010 | Reiss | 446/484 |
| 2012/0028538 | A1 * | 2/2012 | Wong | 446/457 |

FOREIGN PATENT DOCUMENTS

| | | |
|---|---|---|
| GB | 477601 | 3/1935 |
| GB | 925825 | 10/1961 |
| GB | 1 490 105 | 10/1974 |
| GB | 2 299 765 A | 10/1996 |
| GB | 2 388 053 A | 5/2003 |

* cited by examiner

DYNAMO POWERED TOY

CROSS-REFERENCE TO RELATED APPLICATIONS

This application is a continuation of U.S. patent application Ser. No. 11/692,233 filed Mar. 28, 2007 which in turn is a continuation-in-part of U.S. patent application Ser. No. 11/253,522 filed Oct. 19, 2005;

and this application is a continuation-in-part of U.S. patent application Ser. No. 11,405,889 filed Apr. 18, 2006, that in turn is a continuation-in-part of U.S. patent application Ser. No. 10/600,260 filed Jun. 20, 2003, now U.S. Pat. 6,995,542; that in turn is a continuation-in-part of U.S. patent application Ser. No. 10/101,907 filed Mar. 19, 2002 now U.S. Pat. No. 7,030,592;

and this application is a continuation-in-part of U.S. patent application Ser. No. 11/462,414 filed Aug. 4, 2006.

The contents of these applications to which a claim of priority is made are hereby incorporated by reference.

FIELD OF THE INVENTION

The present invention in general relates to a dynamo containing toy and in particular to an amusement moving toy powered by manual dynamo operation.

BACKGROUND OF THE INVENTION

Mechanically powered amusement devices have traditionally relied upon springs and windings to generate movement or sound. Representative of these early amusement devices are music boxes and penny banks. Mechanical mechanisms suffer from a number of limitations including metal fatigue, complex construction, and imprecise movements. As a result, components such as a spring-loaded button provide variable mechanical resistance throughout the travel during depression, and a music box has a characteristic "tinny" sound to the auditory program.

With the advent of miniature electrical motors and speaker components, battery powered amusement devices largely supplanted mechanical movements. Typically, an electrically powered amusement device offers longer usage between reenergizing, wider material choices, and extended movement longevity. The power source for operating electrically powered amusement devices has largely been disposable alkaline batteries. Reliance on disposable battery power creates inconvenience and cost associated with stocking replacement batteries, as well as creating an ecologically noxious waste stream.

An alternative to the use of alkaline batteries is rechargeable batteries of various chemistries. A rechargeable battery upon being discharged is removed from the amusement device and placed into an electrically powered charger typically coupled to line power or a vehicle electrical system as the power origin. Unfortunately, battery recharge to again power an amusement device requires downtime during which the amusement device cannot be used and often involves adult interaction to remove a battery and place the same into a charging device. Additionally, since an extrinsic electrical source is required to charge the battery, ongoing constraints on usage environment for the amusement device and costs remain.

Thus, there exists a need for an electrically powered toy rechargeable by a child absent adult intervention. A further need exists for a dynamo powered rechargeable amusement device alternatively operative between direct dynamo output or from a battery charged by the dynamo.

SUMMARY OF THE INVENTION

A toy is provided that has a dynamo for converting manual movement into an electrical charge for the dynamo located within a housing. A miniature vehicle is induced to locomote through receipt of the electrical charge. A dock is provided for selectively creating an electrical coupling of the vehicle to the dynamo to transfer the electrical charge and decoupling to allow the vehicle to locomote. A charge storage device and an electrical motor in the vehicle allow for prolonged vehicle locomotion separate from the charge transfer by the dynamo.

A toy is also provided that has a dynamo for converting manual movement into an electrical charge, the dynamo located within a housing. The dynamo transfers an electrical charge to a wheeled miniature vehicle through an electrically conductive circuit about which the vehicle travels. Additional amusement functions of LED light output or speaker auditory output are optionally provided.

BRIEF DESCRIPTION OF THE DRAWINGS

The present invention is further detailed with respect to the following exemplary depictions which are not intended to be a limitation upon the practice of the present invention.

DETAILED DESCRIPTION OF THE PREFERRED EMBODIMENTS

The present invention has utility as an amusement device or toy that provides two or more amusement functions such as a movement, a light emitting diode illumination, an auditory output and a video presentation without resort to disposable batteries or the necessity of removing a chargeable battery to effect battery recharge. The present invention performs in this manner through the integration of a manually operated dynamo. As a result, a child user is able to enjoy the amusement device indefinitely without resort to adult supervision to replace or charge a battery. With the inclusion of printed circuit board mounting of operational electronics, superior amusement functions as compared to mechanical amusement functions is achieved. It is appreciated that in several inventive embodiments a battery is optionally not present and instead the amusement device operates directly only through manual operation of a dynamo crank.

Figure 1:
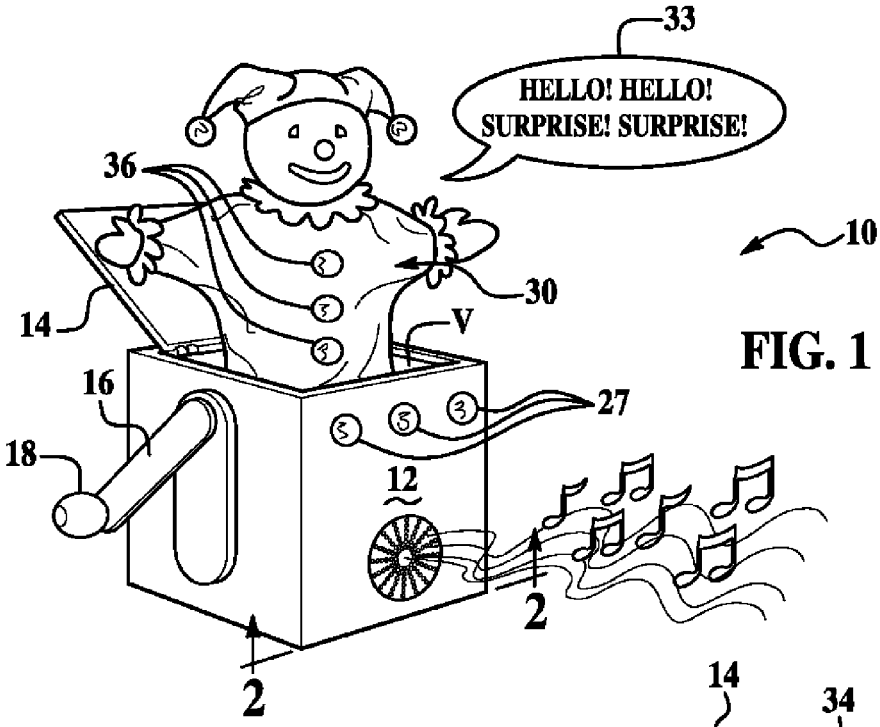
FIG. 1 is a perspective view of a jack-in-the-box embodiment of an inventive dynamo powered amusement device in an open position.
Figure 2:
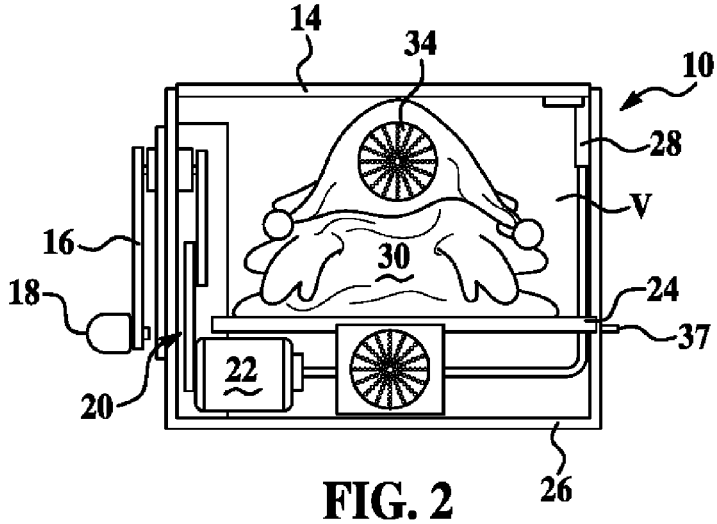
FIG. 2 is a cross-sectional view of the jack-in-the-box embodiment depicted in FIG. 1 in a closed position along line 2-2.

Referring now to FIGS. 1 and 2, an inventive dynamo powered amusement device configured as a jack-in-the-box is shown generally at 10. It is appreciated that the attributes of the device 10 are likewise applicable to a music box that also provides a movement, a light emitting diode illumination or video presentation. The device 10 has a housing defining an internal volume V, the volume V being selectively accessible with the opening of a housing lid 14. A hand crank 16 terminating in a rotatable knob 18 is coupled to a dynamo 22 by way of gearing 20. The gearing 20 operates to translate a single rotation of hand crank 16 into multiple input rotations into a dynamo 22 mechanically coupled to the output of the gearing 20. A conventional dynamo-gearing-crank arrangement is depicted in U.S. Pat. No. 6,959,999. The dynamo 22 provides a direct current electrical output to a printed circuit board 24. Operation of the hand crank 16 powers the dynamo 22 that in turn supplies energy input to power a auditory generator 26 located within the housing 12. LEDs 27 located on the housing 12 are also powered in this manner. The auditory generator 26 is operational at least at such time as the hand crank 16 is being operated. Suitable auditory generators to produce an auditory output for use in the present invention illustratively include a speaker, buzzer, piezoelectric vibratory crystal, a bell, music box, chime, and a bellows. The printed circuit board 24 in turn operates a solenoid switch 28 to electrically induce the opening of lid 14 thereby allowing the internal figure to spring forth from the volume V. Figurine 30 is supported around the perimeter of a weak spring constant coil spring (not shown) as is conventional to the art. Optionally, the figurine 30 is in electrical communication with the printed circuit board 24 so as to provide novel functions to the extended figurine such as auditory presentation 33 by way of a figurine auditory generator 34, light emitting diode emission from LEDs 36 decorating the figurine 30, or an electrically powered movement; each of these functions is provided alone or in combination. Unlike a conventional mechanical jack-in-the-box, the amusement device depicted with reference to FIGS. 1 and 2 preferably has a solenoid opening switch 28 that triggers at a random interval so as to create a heightened sense of anticipation. Alternatively, to mimic the function of a conventional mechanical jack-in-the-box, the solenoid 28 is triggered to release after a cumulative time of crank manipulation. Optionally, a switch 37 is provided to vary the mode of solenoid activation.

Figure 3:
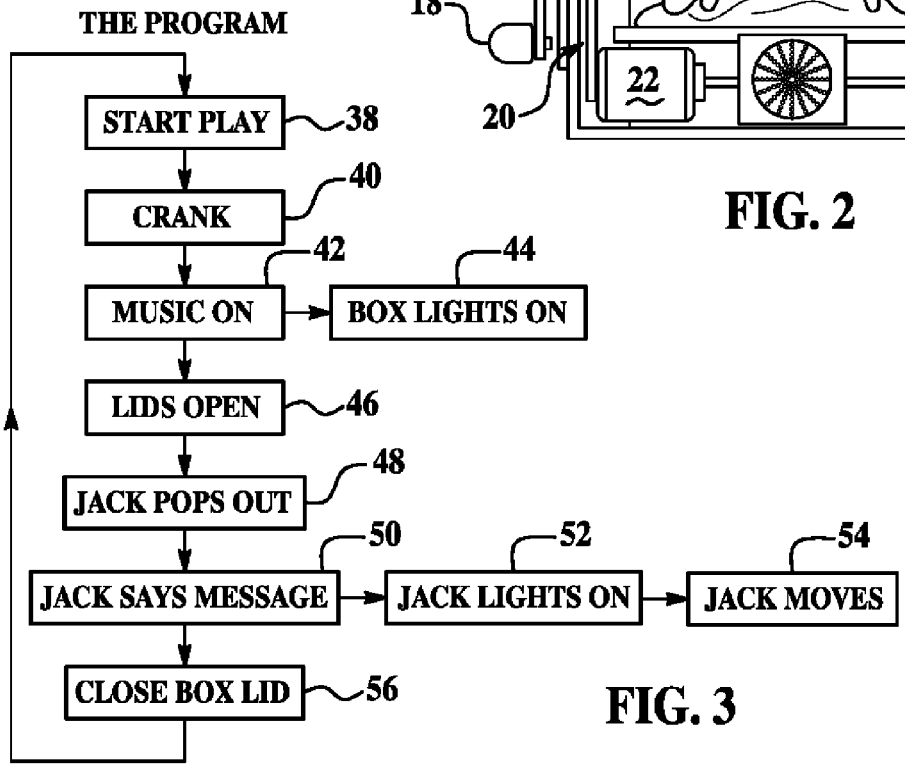
FIG. 3 is a schematic flowchart of an exemplary operating procedure for the jack-in-the-box embodiment of FIG. 1.

A schematic operational diagram for the device 10 as depicted in FIGS. 1 and 2 is shown in FIG. 3 as an exemplary operational program. In order to initiate play at step 38, one begins to crank the hand crank 16 at step 40. With rotation of the dynamo 22, prerecorded music or other audio output is provided from auditory generator 26 at step 42 while LEDs 27 within the housing 12 are also activated at step 44. It is appreciated that the temporal interaction between auditory output 42 and light activation 44 during the course of the cranking at step 40 may include any number of various sequences. Preferably, the auditory output continues continually during cranking while the housing lights blink. Thereafter, the solenoid 28 receives a signal from the printed circuit board 24 causing the lid 14 to open at step 46. The compressed FIG. 30 springs from housing volume V at step 48. The jack figurine 30 then preferably plays a prerecorded program 33 through auditory generator 34, if present, or otherwise from auditory generator 26 and/or LED lights 32 associated with the FIG. 30 are illuminated at step 52. Preferably, the FIG. 30 provides both auditory output and LED light emission. As with steps 42 and 44, the temporal relationship between auditory and optional output can take a variety of forms. Optionally, the FIG. 30 also provides a mechanical motion associated with a secondary solenoid within the figure or a motor (not shown) to initiate figure movement at step 54. A typical movement might include releasing a spring associated with a limb so as to simulate a hand wave of the figure. It is appreciated that the user stops manipulating the hand crank subsequent to step 48 and as such electrical power for steps 50-52 is provided through capacitor energy storage within the printed circuit board 24 during cranking. Alternatively, the functions provided at steps 50-54 are provided by continuing to crank after the jack has emerged from the housing at step 48. With the closing of the lid 14 at step 56, the amusement device 10 is ready again for the initiation of play.

Figure 4:
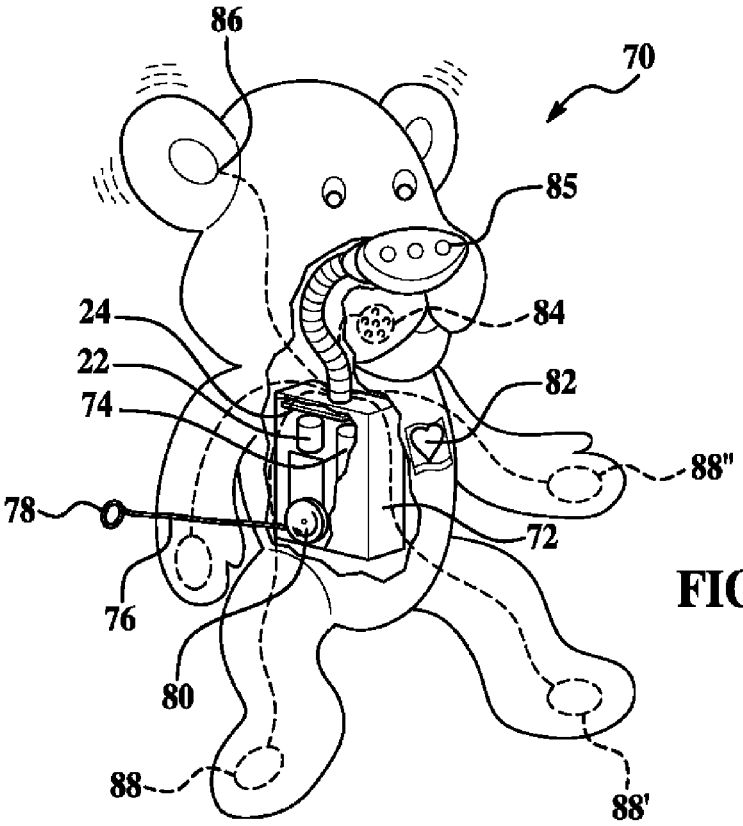
FIG. 4 is a partial cutaway semitransparent view of an animate figurine embodiment of an inventive dynamo powered amusement device.

Referring now to FIG. 4, a partial cutaway semitransparent view of animate figurine embodiment of the present invention is depicted generally at 70 where like numerals correspond to those detailed above with respect to FIGS. 1-3. The figurine 70 as depicted is a plush amusement device configured as a teddy bear. However, it is appreciated that such a figurine is readily constructed to simulate a variety of animal, human, or fanciful creatures and is readily formed from materials illustratively including plush, injection molded thermoplastics, and porcelain. The figurine 70 is in component casing 72. The component casing 72 includes a dynamo 22 providing electrical input to a printed circuit board 24, and optionally a rechargeable battery 74. Rechargeable battery 74 is also in electrical communication with the dynamo and the printed circuit board 24 such that amusement functions driven by printed circuit board 24 are powered either directly from the dynamo 22 or via rechargeable battery 74, that in turn is recharged through operation of the dynamo 22. Extending from component casing 72 is a pull cord 76 terminating in a handle 78. It is appreciated that the size and type of battery 74 is not critical to the present invention. For example, nickel-cadmium, metal hydride, acid, and polymeric batteries are operative herein. Operative battery sizes illustratively include 24 volt, 12 volt, 9 volt, AAA, AA, B, C, and D sized cells. Optionally, the handle 78 is rendered in the form of a figure body portion or accoutrement. The pull string 76 engages a spring-tensioned spool 80 in mechanical communication with the dynamo 22 to induce movement thereof. The figurine 70 in one operational mode commences to provide at least two forms of amusement for a user in the form of LED emission; electrically driven movable jointed appendages such as a jaw, neck, ears or a limb; a auditory generator providing prerecorded music and/or spoken utterances; a microphone recording and a auditory generator playing back the recording; and a video display. While a full complement of amusement functions are depicted on figurine 70, it is appreciated that an inventive device need not be inclusive of all such components. These components depicted in FIG. 4 include a video display 82, a auditory generator 26, a microphone 84, LEDs 85, and a mechanical actuator 86, each of which is in electrical communication with the printed circuit board 24 by way of electrically conductive wires or directly fixtured thereto. At least one switch 88 is optionally provided such that a user elects components that are to be operative to provide an amusement function. By way of example, toddlers are often fearful of a figurine 70 of an animate creature and as such emission from LEDs 85 positioned within the nose of the FIG. 70 is precluded by pressing the left foot switch 88', while for instance 88" activates a prerecorded message.

Figure 5:
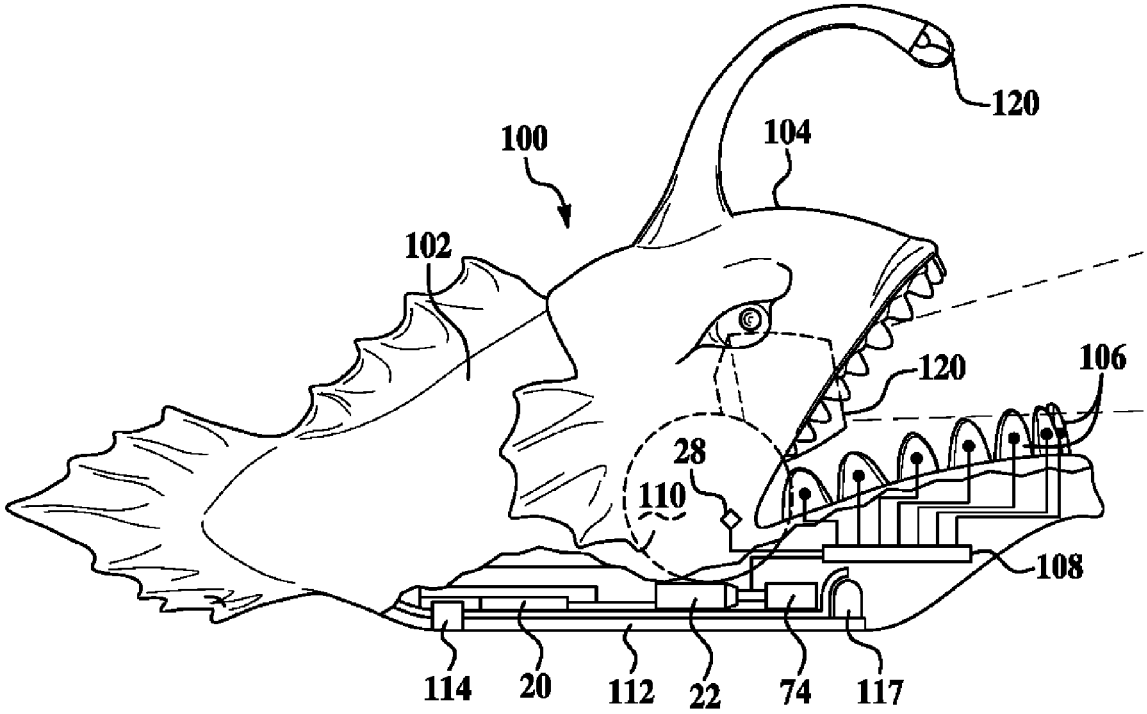
FIG. 5 is a partial cutaway semitransparent view of a chance game embodiment of an inventive dynamo powered amusement device.
Figure 6:
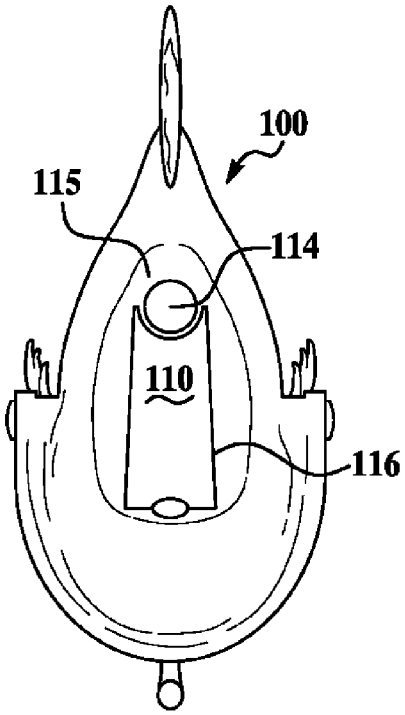
FIG. 6 is a bottom view of the chance game embodiment depicted in FIG. 5.
Figure 7:
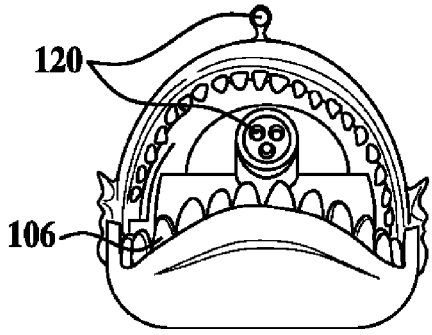
FIG. 7 is a front view of the chance game embodiment depicted in FIG. 5.

Referring now to FIG. 5, a game of chance is depicted generally in partial cross-sectional semitransparent view at 100 where like numerals correspond to those detailed above with respect to those particular elements. The game 100 includes a housing stationary portion 102 having a hingeably attached movable portion 104. The housing portions 102 and 104 in combination are provided in a simulative form of an animal, human, fanciful creature, a cave, or a manmade structure illustratively including a garbage truck and a trap. The housing portions 102 and 104 are each independently formed of an injection moldable thermoplastic, an elastomer or combination subcomponents thereof. A series of electrical switches 106 are exposed upon the hingeable attached movable portion 104 being rotated into an open position. Switches 106 are in electrical communication with a printed circuit board 108 that randomly assigns to one of the multiple switches 106 a circuit connection to a solenoid 28 engaging a spring-loaded hinge 110. Electrical power is provided to the circuit board 108 and ultimately to the solenoid 28 by way of a chargeable battery. The chargeable battery 84 in turn is charged by a dynamo 22. The dynamo 22 generates an electrical output through the rotation of a hand crank 112 rotatable about a spindle 114. Spindle 114 conveys rotational mechanical energy to the dynamo 22 by way of gearing 20. As depicted in FIGS. 5-7, the hand crank 112 is recessed into a basal surface 115 of the stationary housing portion 102. An access door 116 is also optionally provided in the basal surface 115. The hand crank 112 preferably includes a knob 117 that sits within stationary housing portion 102 when not in use. Elevating the handle 112 through an arc of 180 degrees around hinge axis A-A exposes the knob 117 and allows the handle 112 to rotate circumferentially around the spindle 114. In addition to the printed circuit board 108 arbitrarily forming a circuit between one of the switches 106 and the solenoid 28 so as to cause the hingeably attached movable portion 104 to rotate relative to the stationary housing portion 102, the chance game 100 is optionally provided with one or more light emitting diodes 120 or a auditory generator providing a prerecorded audio amusement function (not shown). The LED 120 is in electrical communication with the printed circuit board 108 and derives operational power therefrom.

A chance game as depicted at 100 in FIGS. 5-7 represents a considerable improvement over prior art, nonelectrical forms of such a chance game that operate through mechanical depression of a randomly selected key to induce a hingeable portion to close. Such mechanical versions of this game have a tension associated with the triggering key that can be felt by a game participant prior to triggering so as to avoid that particular key. Additionally, keys adjacent to a triggering key receive a certain bracing based on their position and relative to other nonactive keys so as to afford still another mechanism by which a chance game participant may manipulate the outcome. U.S. Pat. No. 5,193,808 is representative of this prior art supplanted by the present invention.

Figure 8:
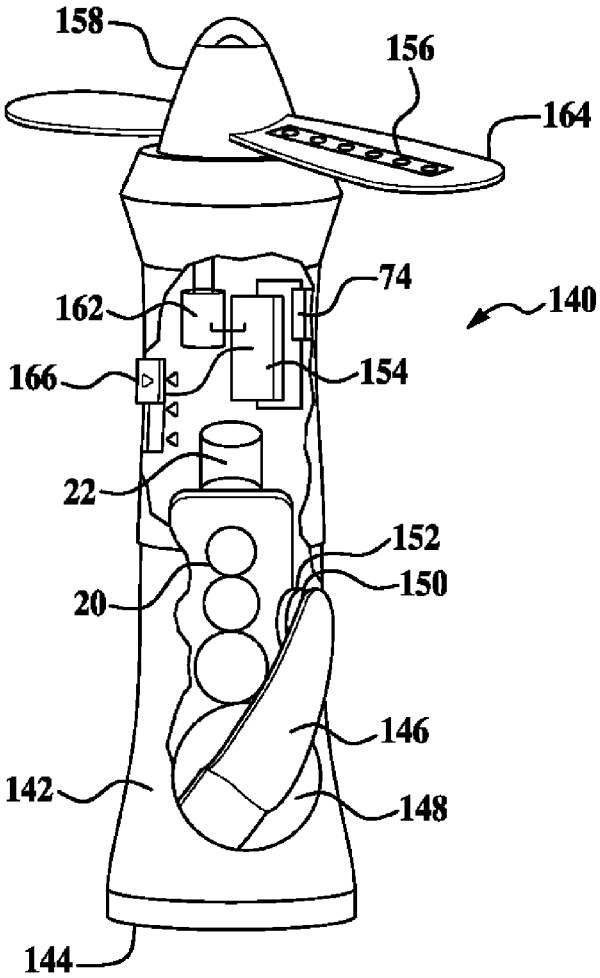
FIG. 8 is a partial cutaway view of a fan torch embodiment of an inventive dynamo powered amusement device.

Referring now to FIG. 8 where like numerals correspond to those detailed above with respect to the previous figures, an inventive amusement device having a rotating lighted portion is depicted generally at 140. The device 140 has a housing 142. Preferably the housing 142 has a planar base 144. The base 144 has dimensions relative to the center of gravity of the device 140 such that the device 140 is operable resting on the base 144. While a variety of conventional materials are well suited for the formation of the housing 142, injection moldable thermoplastic represents a preferred material. A hand crank 146 is mechanically coupled to gearing 20 that feeds the mechanical power to operate a dynamo 22. The hand crank 146 is preferably hingeably connected to a crank spindle 148. More preferably, the crank 146 terminates in a rotatable knob 150. The knob 150 is preferably adapted to insert within a recess 152 within the housing 142. Upon elevating the hand crank 146 through an axis of 180 degrees, the knob 150 is exposed in order to provide power the dynamo 22. The dynamo 22 generates direct current electrical power that is fed to a printed circuit board 154 to either directly power LEDs 156 and rotation of a head portion 158 or alternatively to charge a battery 74 that in turn is used to illuminate LED 156 or the rotation of the head 158 at times when the hand crank 146 is not being operated. An electric motor 162 is operated by way of the printed circuit board 154 to power the rotation of head 158. The head 158 optionally has one or more fan blades 164 so as to provide a measure of air circulation associated with the operation of the device 140. Optionally, an electrical switch 166 is in electrical communication with the printed circuit board 154, the switch 166 extending from the housing 142 to provide various operational modes illustratively including rotation of head 158 only, illumination of LED 156, on/off, or various patterns of LED illumination. An LED 156 is appreciated to be operable in various modes including continuous emission, periodic emission or various patterns of emission associated with multiple LEDs to provide visually interesting effects.

Figure 9:
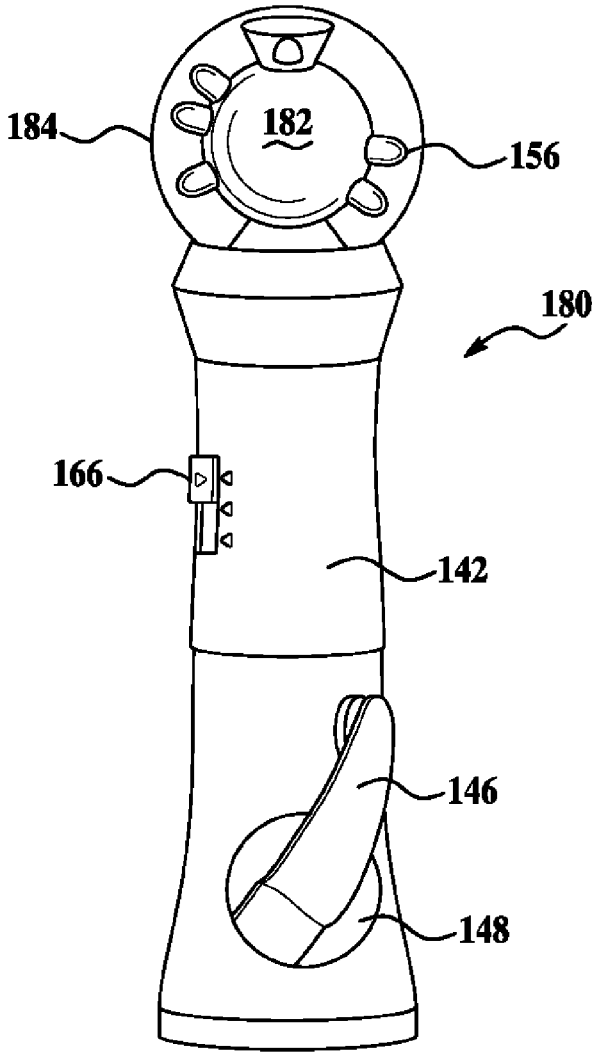
FIG. 9 is a partial cutaway view of a spinning charm torch embodiment of an inventive dynamo powered amusement device.

FIG. 9 depicts an alternate design of an illuminated rotating head amusement device relative to FIG. 8 where like numerals correspond to previously described components. The device 180 depicted in FIG. 9 varies from that depicted in FIG. 8 with regard to the nature of the rotating head 182. The head 182 has LEDs 156 decorating the head 182. A protective transparent globe 184 envelopes the rotating head 182 and is secured to the housing 142.

Figure 10:
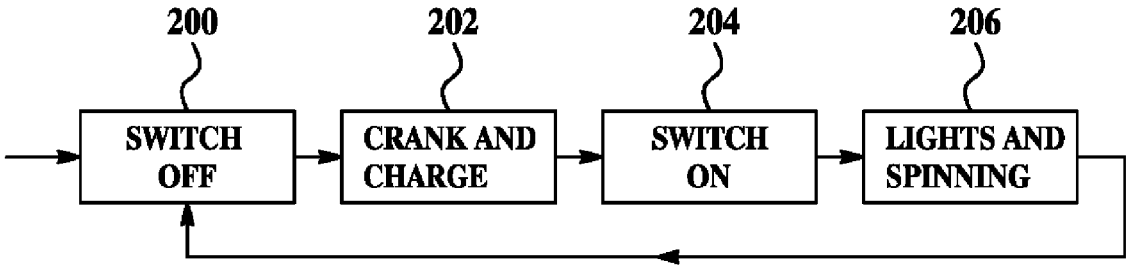
FIG. 10 is a schematic flowchart of exemplary operating procedure for the fan torch embodiment of FIG. 8 or FIG. 9.

A typical operational scheme for an inventive rotating head device as depicted in either FIG. 8 or FIG. 9 is shown as a schematic in FIG. 10. With the rotating head 158 or 182 and the LEDs 156 in an off position, at step 200 the hand crank 146 is elevated through an arc of 180 degrees and cranked so as to charge a battery at step 202. After cranking for a sufficient time to impart charge to the battery 160, the switch 166 is moved to a position to create an electrical circuit between the battery 160 and the LED 156, head 158 or 182, or combination thereof at step 204. Rotation of the head and/or LED illumination thereafter occurs at step 206.

Figure 11:
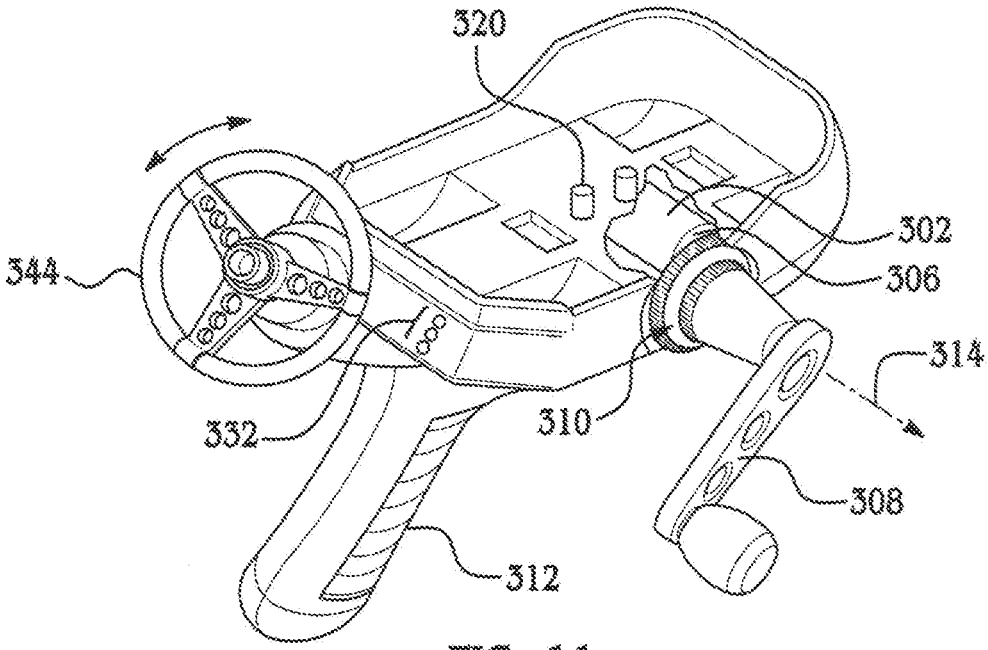
FIG. 11 is a perspective partial cutaway view of a dynamo containing housing adapted to electrically couple to a miniature wheeled vehicle according to the present invention.
Figure 12:
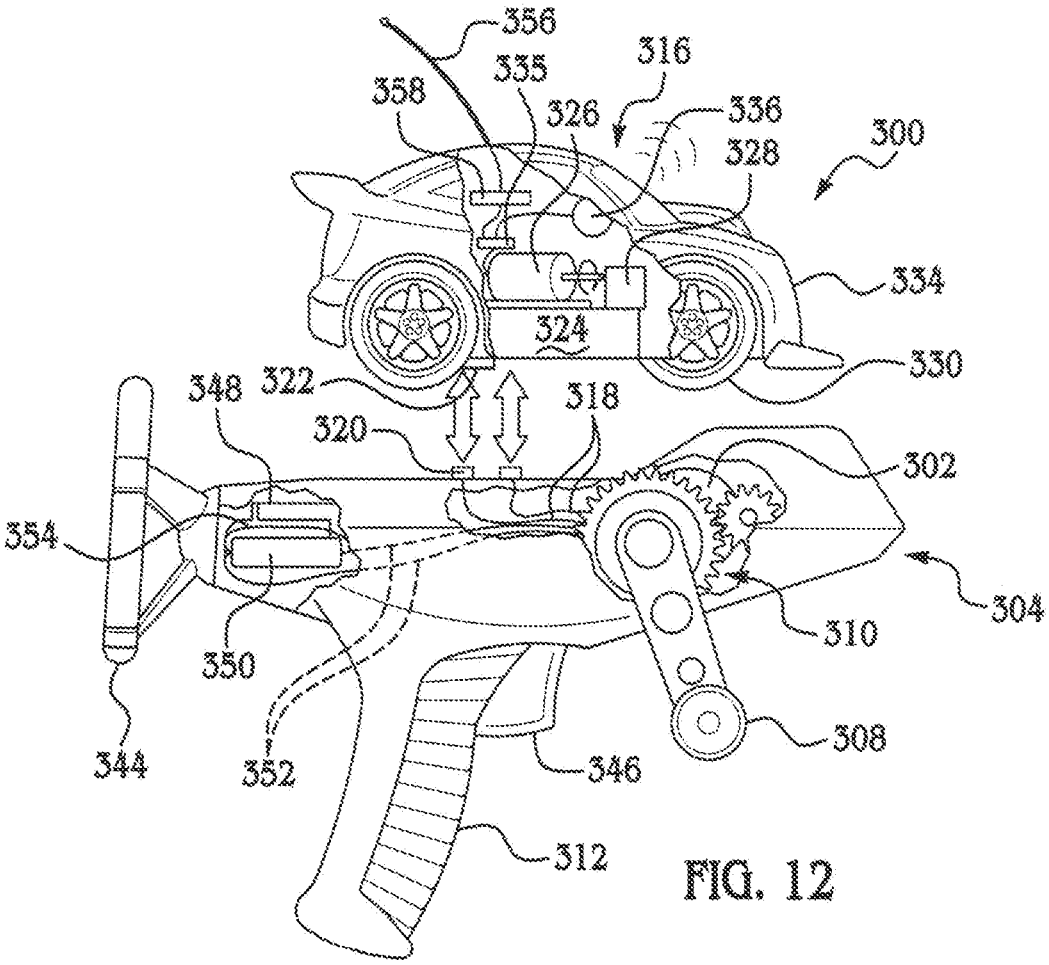
FIG. 12 is an exploded, partial cutaway view of the housing of FIG. 11 and the miniature vehicle.
Figure 13:
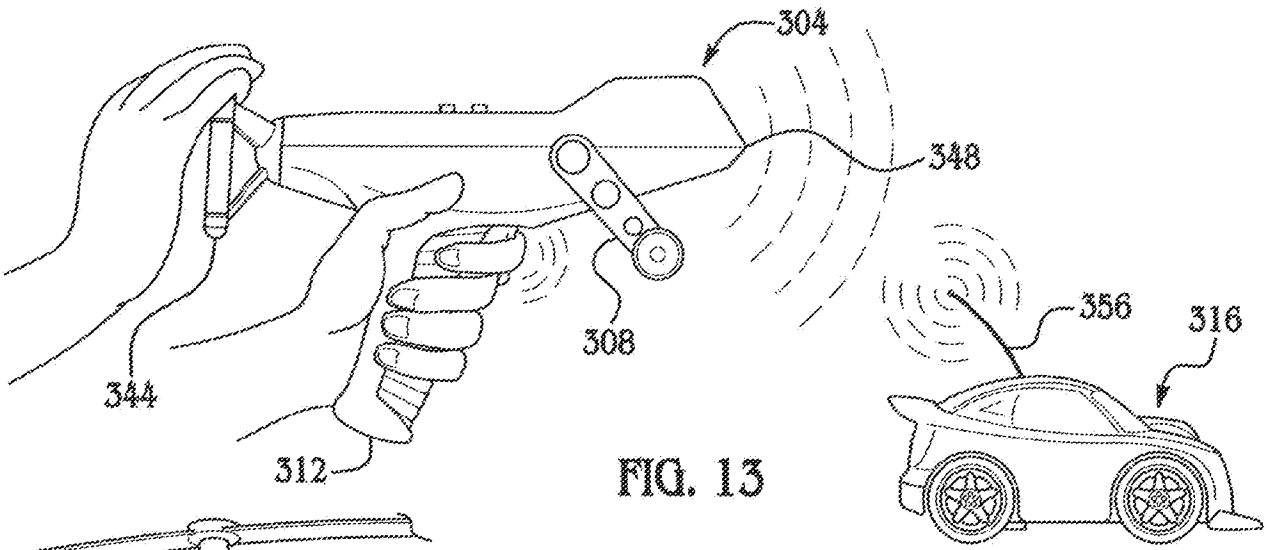
FIG. 13 is a side view depicting operation of the vehicle under remote control from the housing of FIGS. 11 and 12.

Referring now to FIGS. 11-13, a toy vehicle is depicted generally at 300. The toy 300 includes a dynamo 302 within a housing 304. The dynamo has a rotating armature 306 in mechanical communication with a handle 308. Preferably, a gear box 310 is provided intermediate between the armature 306 and the handle 308. The gearing 310 serves to provide a ratio of armature rotation relative to rotation. Typically, if a gearing 310 is present, the gearing ratio of handle:armature rotation is between 1:20-60. To accommodate rotation of the handle 308, the housing 302 includes a grip 312 that facilitates steadying the housing 302 with a user hand while imparting manual energy into the armature of the dynamo 302. It is appreciated that armature 306 rotation is accomplished with a rotary crank handle 308 turning on an axis parallel 314 to that of the armature 306, a hinged trigger manually compressed against another portion of the housing in a grip-like action. A representative rotary crank handle is depicted at 308 in FIGS. 11-13 while a grip-like trigger is depicted at 362 in FIG. 14.

Regardless of the manual movement by which a dynamo armature 306 is rotated, the dynamo 302 creates an electrical charge that is transferred to a miniature vehicle 316 by way of electrically conductive wires 318. While the wires 318 are depicted as terminating in a sexed fitting 320 having a complementary opposite sexed fitting 322 on the vehicle 316, it is appreciated that a variety of detachable power transfer wire configurations are known to the art. The vehicle 316 stores the charge transferred from the dynamo 320 in a charge storage device 324 such as in an ultra-capacitor, rechargeable battery, or combination thereof. It is appreciated that an ultra-capacitor is able to be charged more rapidly than a rechargeable battery at the expense of less efficient long term charge storage. The charge within the toy vehicle storage device 324 is used to power movement of the vehicle through energizing an electric motor 326. Optionally, gearing 328 is placed in mechanical communication between the electric motor and a powered wheel 330 of the vehicle so as to modify powered wheel torque relative to electric motor torque. Alternatively, a flywheel within the vehicle is induced to rotate by the charge storage device 324 so as to store mechanical energy for subsequent feed to the powered wheel 330 of the vehicle 316 through charge induction from the dynamo 320. Optionally, an indicator as to charge status of the vehicle power storage is provided. A charge status indicator 332 illustratively includes light emitting diode activation, a bar of light emitting diodes, or rotational speed of a powered wheel of the vehicle 316. Optionally, the vehicle 316 is provided with an LED 334 to provide a visual output, a speaker 336 providing an audio output, or a combination thereof to further enhance the effect of the toy vehicle 316. Preferably, a circuit is provided to drive outputs 334 and or 336, moderate charge delivery to the motor and instances where a remote control is present to convert RF signals received into operational electrical signals.

Optionally, a remote control unit 342 is provided in the housing 304 and inclusive of control of at least one movement parameter inclusive of direction; electric motor rotation between for example vehicle nonmovement and full speed; and delivered torque. The control unit 342 as depicted in FIGS. 11-13 includes a steering wheel 344 to control vehicle direction and a throttle 346 to control motor speed. A radio control transmitter 348 is also provided within the housing. To allow operation of the remote control unit 3442, a charge storage device 350 is provided within the housing 304. While preferably the charge storage device is powered by operation of the dynamo 302 by wires 352, it is appreciated that the use of a conventional disposable, nonrechargeable battery is also suitable to power the remote control unit. Circuitry 354 is provided to convert movement of the steering wheel 350 and throttle 346 to related electrical signals for transmission by EF transmitter 348. The vehicle 316 operated by the remote control unit 342 includes a radio frequency antenna 356 receiving movement directions from the remote control unit as well as circuitry for translating radio control commands to vehicle movement. The radio frequency antenna 356 tuned to the radio control unit 342 and radio control circuitry 358 controlling operation of the electric motor 326 are also powered by the charge storage device 324.

Figure 14:
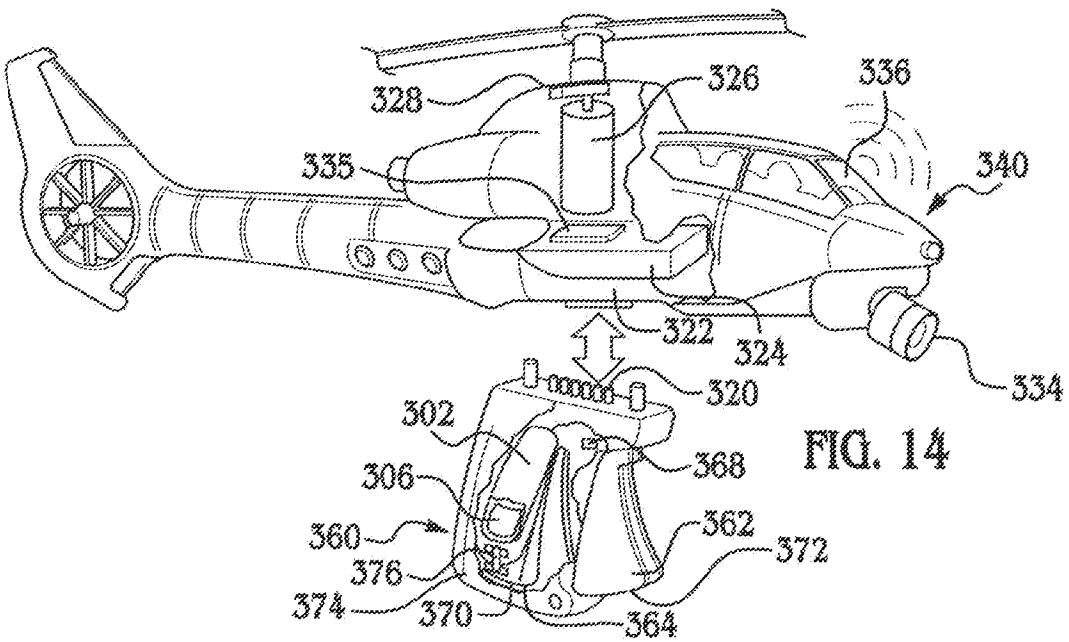
FIG. 14 is a perspective, partial cutaway view of a housing and a miniature prop vehicle according to the present invention.

In addition to the electric motor 326 powering a drive wheel 330, as shown in FIG. 12, the electric motor 326 readily powers a prop of a miniature vehicle 340 such as helicopter, airplane, boat, and airship. An electric motor powering a prop is depicted in FIG. 14 where like numerals correspond to those used with respect to FIGS. 11-13.

A housing 360 includes a trigger 362 held in an extended position by a leaf spring 364. The leaf spring 364 tensioned against a rail 366 within the housing 360. The trigger 362 has a pivot mount 368 and a pawl 370 extending from the base 372. The pawl 370 engages a rotary gear 374 to convert linear motion of trigger 362 to a rotary motion that in turn enmeshes a gear 376 coupled to the armature 306 or dynamo 302. Wires 318 interconnect the dynamo 302 and the sexed fitting 320. The vehicle 340 has a prop 380 rotating under the power delivered by the motor 326.

Figure 15A:
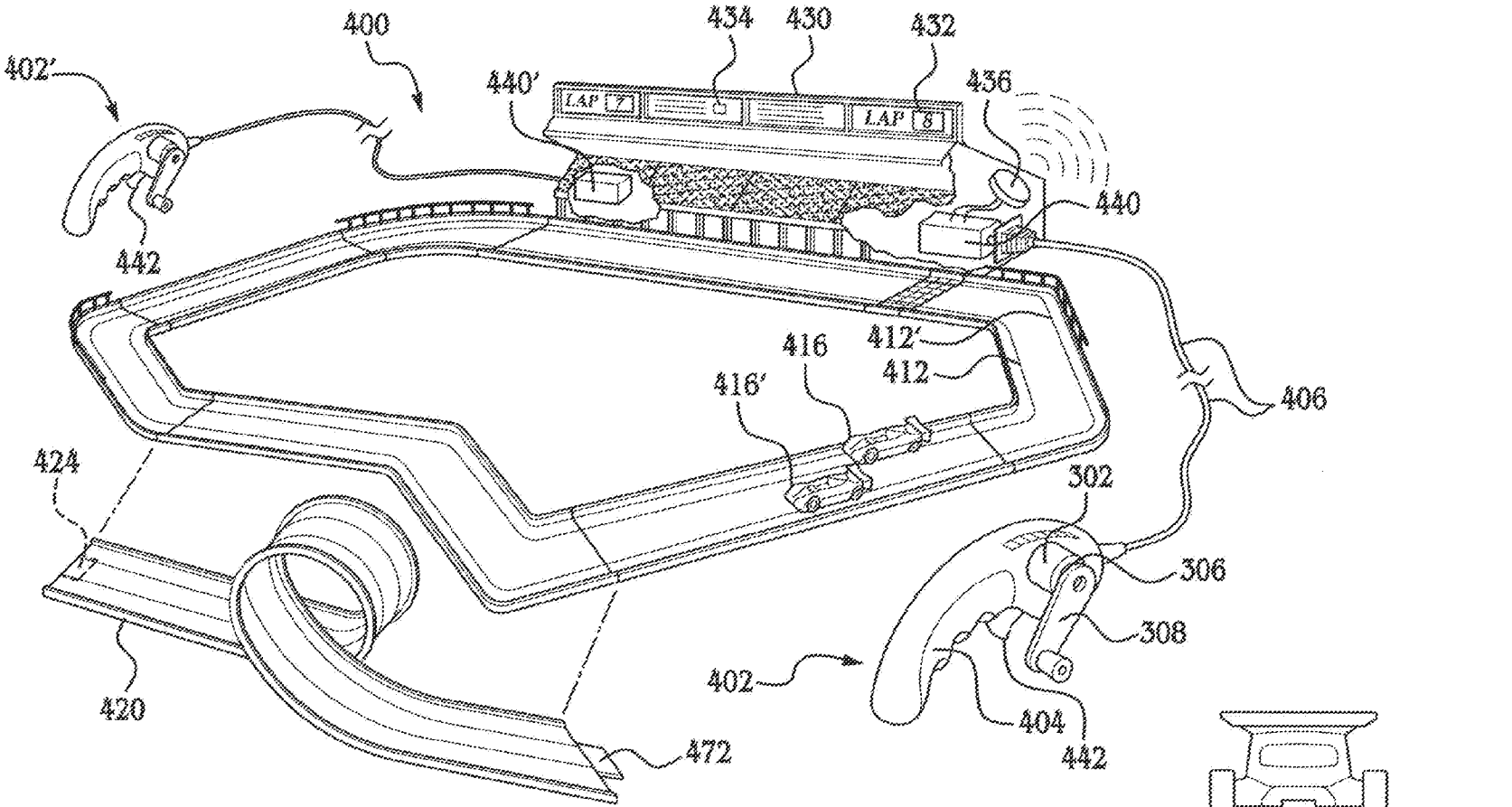
FIG. 15 is a perspective, partial cutaway view of a dynamo powered circuit about which a wheeled miniature vehicle travels according to the present invention.
Figure 15B:
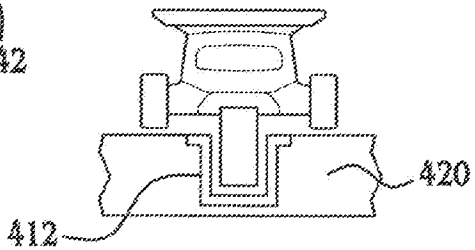

Referring now to FIG. 15, a track game is depicted generally at 400. The track game 400 includes a housing 402 having a grip 404. A dynamo 302 is mounted within the housing 402 for converting manual movement into an electrical charge. While a crank handle 308 is depicted in FIG. 15A and 15B 362 for converting manual movement into an electrical charge, is appreciated that a trigger-type converter is readily provided to convert manual movement into dynamo armature 306 rotation. An electrical charge generated by the dynamo 302 is conveyed by way of conductive insulated wire 406 to an electrically conductive circuit 412. The circuit 412 is supported by an electrically insulating support 414. A throttle control 442 is optionally provided on the housing to provide control of miniature vehicle speed operative to control miniature vehicle speed to less than that achievable through immediate rotation of the dynamo armature by manual movement. A miniature vehicle 416 has an electrically conductive fixture 418 complementary to the circuit 412 and adapted to engage the circuit. As depicted in FIG. 15A, a duplicate housing 402 inclusive of a dynamo and electrically connected to a circuit is provided to create a racetrack toy, where duplicate components are denoted by primed reference numerals. In addition to a circuit game, it is appreciated that a dynamo powered vehicle circling a circuit is readily fashioned as a model train, a horse race, foot race and other circuit type toys that previously have been fashioned to operate with spring power, line power, or disposable batteries. While the circuit depicted is continuous and planar, it is appreciated that a section of circuit 420 is readily formed to extend into a vertical direction as a loop or takeoff and landing ramps. It is appreciated that a circuit segment 420 constructed with complementary fittings 422 and 424 between adjacent portions of circuit are readily disassembled for storage and modified to include various segments to allow a user to customize the circuit. In the instance of a circuit segment including takeoff and landing ramps that have an electrical discontinuity, electrical continuity is maintained along a support surface while the electrical fitting of the vehicle runs on an electrically insulative portion between the ramp sections. A segment of circuit extending in a vertical direction to form a loop is also shown in FIG. 15A.

Optionally, the circuit toy 400 has a simulative grandstand 430 inclusive of an additional electric charge powered attribute such as a lap counter 432, LED lights 434, and sound producing speaker 436 generating sounds such as those simulative of a crowd or the miniature vehicle. In a simplest form, the toy provides a competitive speed between vehicles 416 and 416' with vehicle speed defined as a function of the rate at which manual movement is converted to electrical charge through operation of the dynamo 306. Optionally, the toy 400 includes a charge storage device 440 and 440' such as a rechargeable battery or ultra-capacitor coupled to each dynamo 306 {a like dynamo in housing 402'} to allow movement of a miniature vehicle, as well as operation of sound effects, light effects, or a combination thereof, if such features are present, without the simultaneous input of manual movement to provide electrical charge.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

is the invention claimed is:

1. A toy comprising:

a housing;

a dynamo within said housing converting manual movement into an electrical charge;

a vehicle charge storage device storing the electrical charge generated by said dynamo, said vehicle charge storage device being an ultra-capacitor;

a miniature vehicle having said vehicle charge storage device located therein and receiving the electrical charge, said miniature vehicle having a prop that rotates to induce locomotion in water or through air from receiving the electrical charge;

a dock for selectively creating an electrical coupling of said vehicle to said dynamo to transfer the electrical charge and decoupling to allow said vehicle to locomote; and a grip that facilitates steadying said housing while imparting manual energy into an armature of said dynamo.

2. The toy of claim 1 wherein said dock comprises a male electrically conductive element extending from one of said housing and said vehicle and a complementary female electrically conductive element extending from the other of said housing and said vehicle.

3. The toy of claim 1 further comprising a handle moving relative to said dynamo.

4. The toy of claim 3 wherein the handle displaces linearly relative to said dynamo.

5. The toy of claim 3 wherein the handle rotates relative to said dynamo.

6. The toy of claim 1 further comprising:

a remote control unit exerting wireless control over at least one locomotive property of said vehicle selected from the group consisting of: speed and direction; and a remote control antennae extending from said vehicle and receiving wireless control signals rom said remote control unit to control the at least one locomotive property.

7. The toy of claim 6 wherein said remote control unit further comprises a manual control extending from said housing.

8. The toy of claim 1 wherein said miniature vehicle is an airplane.

9. The toy of claim 1 wherein said miniature vehicle is a helicopter.

10. A toy comprising:

a housing;

a dynamo within said housing converting manual movement into an electrical charge;

a vehicle charge storage device storing the electrical charge generated by said dynamo, said vehicle charge storage device being an ultra-capacitor;

a miniature vehicle having said vehicle charge storage device located therein and receiving the electrical charge to induce locomotion;

a dock for selectively creating an electrical coupling of said vehicle to said dynamo to transfer the electrical charge and decoupling to allow said vehicle to locomote; and a grip that facilitates steadying said housing while imparting manual energy into an armature of said dynamo.

11. The toy of claim 10 wherein said dock comprises a male electrically conductive element extending from one of said housing and said vehicle and a complementary female electrically conductive element extending from the other of said housing and said vehicle.

12. The toy of claim 10 further comprising a handle moving relative to said dynamo.

13. The toy of claim 12 wherein the handle displaces linearly relative to said dynamo.

14. The toy of claim 12 wherein the handle rotates relative to said dynamo.

15. The toy of claim 10 further comprising:

a remote control unit exerting wireless control over at least one locomotive property of said vehicle selected from the group consisting of: speed and direction.

16. The toy of claim 15 wherein said remote control unit further comprises a manual control extending from said housing.

17. A toy comprising:

a housing;

a dynamo within said housing converting manual movement into an electrical charge;

a vehicle charge storage device storing the electrical charge generated by said dynamo, said vehicle charge storage device being an ultra-capacitor;

a miniature vehicle having said vehicle charge storage device located therein and receiving the electrical charge, said miniature vehicle having a prop that rotates to induce locomotion through air from receiving the electrical charge and is an airplane;

a dock for selectively creating an electrical coupling of said vehicle to said dynamo to transfer the electrical charge and decoupling to allow said vehicle to locomote; and a grip that facilitates steadying said housing while imparting manual energy into an armature of said dynamo.

* * * * *